US005775497A

United States Patent [19]

Krulik

[11] Patent Number: 5,775,497

[45] Date of Patent: Jul. 7, 1998

[54] PORTABLE CRADLE FOR A PERSONAL COMPUTER

[75] Inventor: Richard J. Krulik, Dix Hills, N.Y.

[73] Assignee: United States Luggage, L.P., Hauppauge, N.Y.

[21] Appl. No.: 762,715

[22] Filed: Dec. 10, 1996

[51] Int. Cl.[6] ..... B65D 85/00

[52] U.S. Cl. ..... 206/320; 206/583; 190/102

[58] Field of Search ..... 206/320, 523, 206/583; 190/100, 102, 103, 124; 229/67.1, 67.3

[56] References Cited

U.S. PATENT DOCUMENTS

| | | | |
|---|---|---|---|
| 3,185,198 | 5/1965 | Bryan | 150/52 |
| 5,010,988 | 4/1991 | Brown | 190/104 |
| 5,160,001 | 11/1992 | Marceau | 190/102 |
| 5,217,119 | 6/1993 | Hollingsworth | 206/583 |
| 5,388,692 | 2/1995 | Withrow et al. | 206/320 |
| 5,445,266 | 8/1995 | Prete et al. | 190/102 |
| 5,494,157 | 2/1996 | Golenz et al. | 206/320 |
| 5,524,754 | 6/1996 | Hollingsworth et al. | 206/583 |
| 5,529,184 | 6/1996 | Sadow | 206/583 |

*Primary Examiner*—David T. Fidei
*Attorney, Agent, or Firm*—Abelman, Frayne & Schwab

[57] ABSTRACT

A modular, self-contained, protective carrying-case for an electronic unit, such as a laptop computer, is disclosed. The laptop computer is tightly and snugly contained within a sling, which is resiliently located between a pair of cushioned, rigidized, side boards. The carrying-case is compact and includes appropriate cushioning for the laptop computer, so as to readily permit the carrying-case, including the laptop computer, to be inserted into a business case or other articles of luggage, such as a wheeled carry-on case, backpack, briefcase, zippered portfolio or attache case.

12 Claims, 3 Drawing Sheets

10'
44'
40-1'
42-1'
25'
19'
14'
L
24'
20'
29'
41-1'
40-1'
42-1'
43"
45"
10"
42"
25"
44"
29"
44"
45"
19"
42"
43"
44"
45"
20"
42"
43"
44"
45"

PORTABLE CRADLE FOR A PERSONAL COMPUTER

FIELD OF INVENTION

This invention relates to a modular, self-contained, protective carrying case for an electronic unit, such as a laptop computer, which protectively positions the laptop computer within a cushioned cradle support.

BACKGROUND OF INVENTION

Laptop-type personal computers are designed for substantial portability, such that the user may readily transport the laptop computer to locations, other than at a permanent installation. Recognizing the relative sensitivity of the laptop computer, appropriate protection must be provided during transportation of the laptop computer to insure that dropping or other jarring thereof will not result in damage to the laptop computer. Accordingly, a variety of carrying cases have been proposed which are luggage-type products customized to contain the laptop computer. Such luggage-type carrying cases are typically shown in Hollingsworth U.S. Pat. No. 5,217,119; Marceau U.S. Pat. No. 5,160,001; and, Brown U.S. Pat. No. 5,010,988. Such prior art laptop computer carrying cases are designed to carry only the laptop computer, and possibly auxiliary components (e.g., floppy disks). Hence, they must be carried as an independent article of luggage for the laptop computer. This can be particularly inconvenient when the user has other articles of luggage and a business case for transporting products other than the laptop computer.

OBJECTS AND SUMMARY OF THE INVENTION

Accordingly, it is desired to provide an appropriate, protective carrying case for the laptop computer which may be placed within conventional luggage or a business case (i.e., a wheeled carry-on case, backpack, briefcase, zippered portfolio or attache case), while providing the requisite cushioned protection for the laptop computer.

Further, the easy recognition of a separate carrying case for a laptop computer, which is relatively expensive, has facilitated thievery of laptop computers at transportation terminals and other public gathering places. Accordingly, the ability to conceal the laptop computer in a conventional business case or other articles of luggage reduces the tendency of such thievery.

It is therefore an object of the present invention, to provide a modular, self-contained, protective carrying case for the laptop computer which can be inserted, as an integral unit, within a business case or other articles of luggage. Preferably, the present carrying case is readily adjustable in size to accommodate variations in laptop computers, and includes appropriate cushioning and resilient materials for snugly containing the laptop computer in a shock-absorbing unit. Advantageously, the carrying case adds minimal additional volume to the laptop computer, and is of a simple, low cost, construction.

Specifically, the modular, self-contained, protective carrying case of the present invention includes a pair of substantially rigid side boards which are in spaced, substantially parallel arrangement. The side boards are preferably of a rectangular shape, with an elastically resilient generally U-shaped sling extending between inner planar surfaces of the sideboards. Each of the open ends of the U-shaped sling is secured to a respective one of the inner side board surfaces at its top-edge region, with the central section of the "U" depending towards the bottom edges of the side boards. Preferably, both the bottom of the "U" and the securement of the open ends of the "U" to the side boards are displaced from the bottom and top edges of the side boards. Cushioning material is contained in at least the side boards, and preferably also along the arms of the U-shaped sling. Side straps, which preferably include resilient material, urge the side boards toward each other, such that when the laptop computer is inserted into the sling, through the open top edges of the side boards, the side straps will urge the side boards and arms of the "U" towards each other to tightly and snugly retain the laptop computer within the sling. The side straps will also advantageously include cushioning material.

Various modified embodiments are shown. For example, the resilient side straps can either (a) permanently connect the edges of the side boards towards each other, or (b) include separate members which are connected to each other at their free ends by a releasable connecting means (e.g., a Velcro fastener). Further, the top edge opening for the insertion of the laptop may be along (a) the longer side of the rectangular side board, typically where it is intended to be placed in a conventional type of hand-carried luggage, or (b) alternatively, along the narrower edges of the rectangle, where it is intended to be transported within a backpack.

Advantageously, the compactness, simplicity, and relatively low cost of the present carrying case facilitates its use as a protective portfolio when transporting the laptop computer between different locations within an office, or during temporary storage within the office while the laptop computer is not in use. Such protective portfolio containment of the laptop computer advantageously protects it against dropping, jarring, or other movements within one's office or home, which could otherwise result in damage to the laptop computer.

Accordingly, it is a primary object of the present invention to provide a modular, selfcontained, protective carrying-case for an electronic unit, such as a laptop computer, which does not require a separate article of hand luggage.

A further object of the present invention is to provide such a modular, self-contained, protective carrying-case in which the laptop computer is protectively contained within a cushioned sling.

Another object of the present invention is to provide such a modular, self-contained, protective unit for a laptop computer which readily permits the safe packing of the laptop computer within another article of luggage or a business-type case, with minimal increased volume requirements beyond that of the laptop computer.

Yet another object of the present invention is to provide such a modular, self-contained, protective carrying-case for the laptop computer which is of simple construction, and of relatively low cost.

These as well as further objects of the present invention will become apparent upon the following description and drawings in which:

DESCRIPTION OF THE PREFERRED EMBODIMENTS

Figure 1:
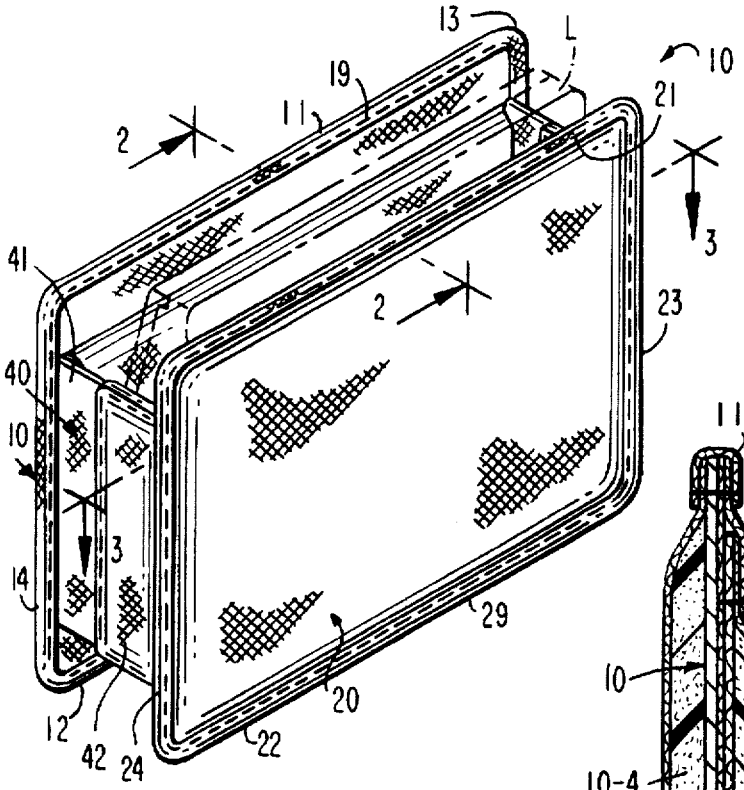
FIG. 1 is a perspective view of one form of the present invention.
Figure 2:
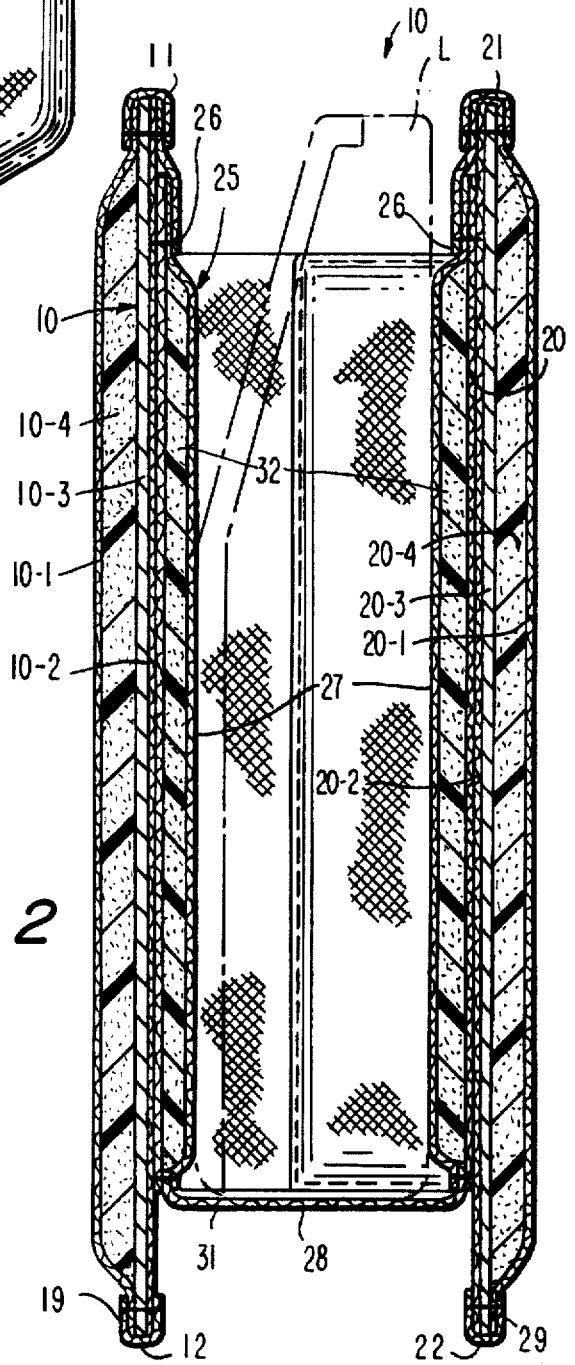
FIG. 2 is a cross-sectional view along the arrows 2—2 as shown in FIG. 1.
Figure 3:
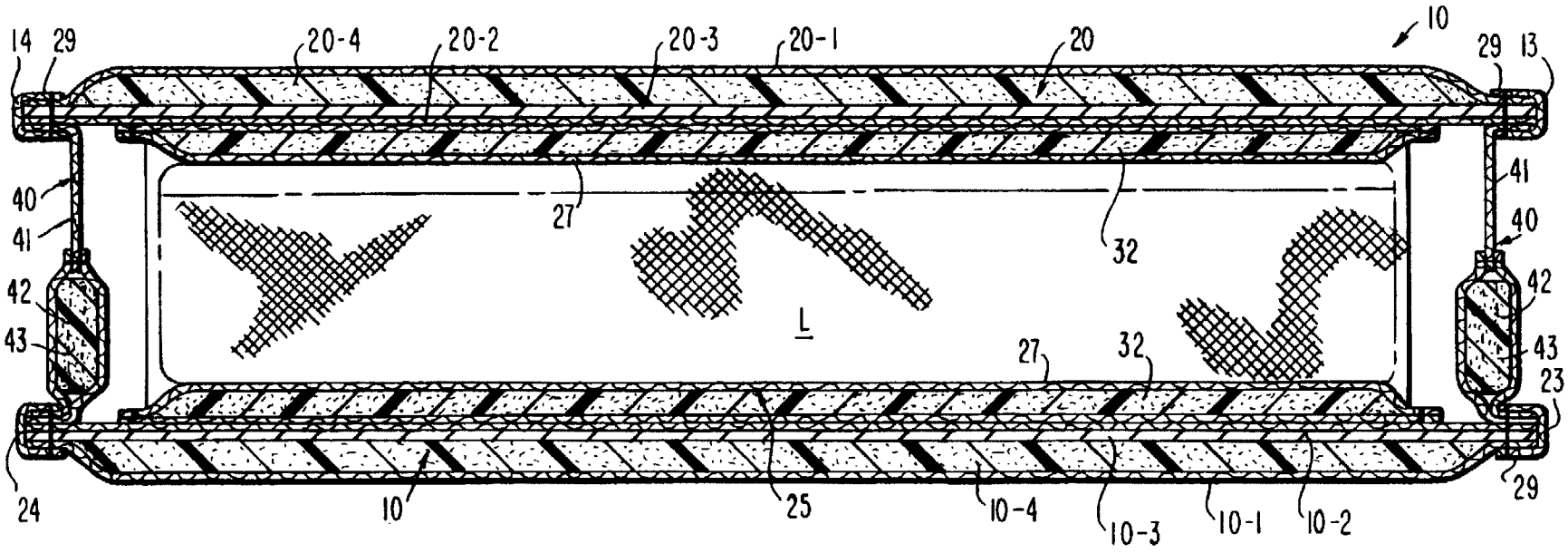
FIG. 3 is a cross-sectional view along the arrows 3—3 as shown in FIG. 1.

Referring initially to the embodiment shown in FIGS. 1–3, the modular, self-contained, protective carrying-case 10 of the present invention is adapted to snugly receive an electronic unit, such as the laptop computer "L". The carrying-case comprises a pair of substantially rigid side boards 10,20. The side boards include top edges 11,21, bottom edges 12,22, right edges 13,23, and left edges 14,24. An elastically resilient generally U-shaped sling 25 extends between the inner planar surfaces of the side boards 10,20. Each of the open ends 26 of the U-shaped sling is secured to respective ones of the side boards at their top edge region, preferably displaced somewhat from the top edges 11,21. The arms 27 of the sling extend downwardly towards the bottom edge region of the side boards, and are connected together by a resilient member 28 which, will preferably be upwardly displaced from the bottom edges 12,22 of the side boards.

Each of the side boards 10,20 includes outer surfaces 10-1, 20-1, and space inner surfaces 10-2 and 20-2. These surfaces are formed of a rugged, aesthetically attractive material, such as nylon, vinyl or a textile fabric. The rigidness of the side boards is provided by a layer 10-3, 20-3 which may typically be a non-flexible sheet of plastic material. An intermediate cushioning layer, 10-4, 20-4 is provided, which may typically be sponge-rubber or comparable plastic foam material. The several layers forming the side boards 10,20 are bound by peripheral binding 19,29.

The arm portions 27 of the sling member may typically be covered by the same material which covers the outer and inner surfaces of the side boards 10,20. Preferably, cushioning material 32 is also provided along and within the arms forming the "U" of the sling. The central section of the sling, shown at 31, is formed of a resilient material.

A pair of, preferably identically constructed, side straps 40 are provided along the side edge openings of the side boards 10,20. The side straps preferably include a resilient section 41 and a cushioned section 42. The cushioned section 42 has outer and inner walls, preferably formed of the same material, comprising the outer surfaces of the side boards 10,20, and arms 27 of the sling. The interior cushioning material 43 is preferably the same material provided within the side boards 10,20 and arms 27 of the sling. Each of the side straps 40 shown in the embodiment of FIGS. 1–3, comprise a single member, the opposite ends of which are secured to their respective side edges of their sideboards by the peripheral binding 29.

The resilient member at the bottom 31 of the "U", and sections 41 of the side straps are formed of an elastic material, such that when the laptop computer "L" is inserted into the carrying case 10, along the top edge 11, and rests within the sling 25, the side boards will be urged towards each other, while the bottom of the "U" is urged inward, to snugly retain the laptop computer "L". Accordingly, carrying-case 10 functions as a modular, self-contained, protective carrying-case for the laptop computer in a very compact manner. Should it be desired to transport the laptop computer, the entire unit may be readily placed within another article of luggage, such as a wheeled carry-on case, with the cushioning material contained within the side walls 10,20, sling section 31, and side straps 42 surrounding and appropriately protecting the laptop computer. Hence, the laptop computer can be readily transported without necessitating a separate article of luggage, as had been typically required by the prior art.

Figures 4, 5:
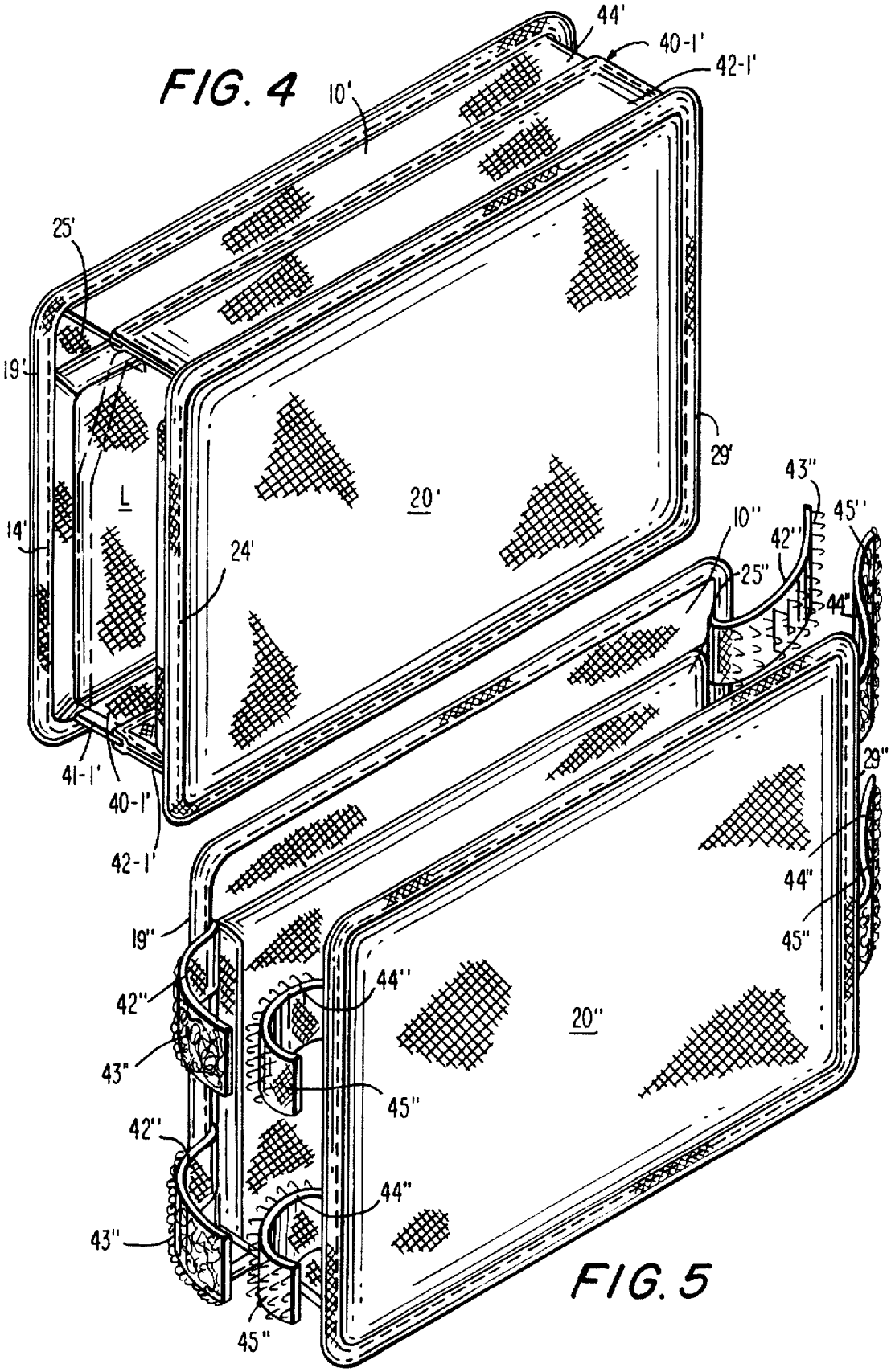
FIG. 4 is a perspective view, generally corresponding to FIG. 1, but showing a modified form.
FIG. 5 is another perspective view, generally corresponding to FIG. 1, but showing still a further modification.

FIG. 4 shows a modified form of the carrying case of FIGS. 1–3, wherein like components are designated by the same numbers with a prime suffix. The variation of FIG. 4 is providing the opening for the laptop computer along the narrow edges 14',24' of the side boards with the edge side straps 40-1' now being provided along the longer sides of the rectangular side boards. Straps 40-1' include resilient sections 41-1' and cushioned sections 42-1'. Hence, the unit shown in FIG. 4 is in all respects similar to that shown in FIGS. 1–3, except that the opening is along the narrow side. The modified configuration of FIG. 4 facilitates the placement of the protective carrying-case within a backpack.

FIG. 5 shows still a further embodiment wherein like components are designated by the same numbers with a double prime suffix. In this embodiment the side straps are each formed of a pair of first and second members 42",44" having a releasable connection at their free ends, such as complementary Velcro pressure fasteners 43',45'.

It should naturally be understood that various other modifications may be made in accordance with the present invention, within the scope of the appended claims.

What is claimed is:

1. A modular, self-contained protective carrying case for a laptop computer, comprising:

a pair of substantially rigid side boards in spaced, substantially parallel, arrangement;

each of said side boards having top, bottom, and right and left edges, and inner and outer generally planar surfaces extending between said edges;

an elastically resilient generally U-shaped sling extending between the inner planar surfaces of said side boards, each of the open ends of the "U" secured to respective ones of said inner side board surfaces at their top edge region, with the central section of the "U" depending towards said bottom edges;

cushioning material contained in at least the side boards between the inner and outer planar surfaces, a long the arms of the U-shaped sling;

a first side strap connected between the right edges of said side boards, and a second side strap connected between the left edges of said side boards;

the top edges of said side boards providing an access opening for inserting an electronic unit and removing same from within said sling, with said side straps urging said side boards towards each other to tightly and snugly retain the electronic unit within the sling therebetween.

2. A modular, self-contained protective carrying case of claim 1, wherein cushioning material is contained within both side boards and the arms of the U-shaped sling.

3. A modular, self-contained protective carrying case of claim 1, wherein said side straps include resilient material for urging said side boards towards each other.

4. A modular, self-contained protective carrying case of claim 3, wherein at least one of said side straps is permanently connected between the right or left side edges of the side boards.

5. A modular, self-contained protective carrying case of claim 3, wherein both of said side straps are permanently connected between their respective right or left side edges of the side boards.

6. A modular self-contained protective carrying case for a laptop computer, comprising:

a pair of substantially rigid side boards in spaced, substantially parallel, arrangement:

each of said side boards having top, bottom, and right and left edges, and inner and outer generally planar surfaces extending between said edges;

an elastically resilient generally U-shaped sling extending between the inner planar surfaces of said side boards, each of the open ends of the "U" secured to respective ones of said inner side board surfaces at their top edge region, with the central section of the "U" depending towards said bottom edges;

cushioning material contained in at least the side boards between the inner and outer planar surfaces, along the arms of the U-shaped sling;

a first side strap connected between the right edges of said side boards, and a second side strap connected between the left edges of said side boards;

the top edges of said side boards providing an access opening for inserting an electronic unit and removing same from within said sling, with said side straps urging said side boards towards each other to tightly and snugly retain the electronic unit within the sling therebetween at least one of said side straps including first and second members, a first member having one end secured to the side edge of one of said side boards and a second member having one end connected to the side edge of the other side board, the free ends of said first and second members including connecting means for releasably connecting said first and second members.

7. A modular, self-contained protective carrying case of claim 6, wherein at least one of said first or second strap members includes resilient material for urging said side boards towards each other.

8. A modular, self-contained protective carrying case of claim 6, wherein said connecting means includes a pressure fastener.

9. A modular, self-contained protective carrying case of claim 1, wherein the arms of the "U" are formed of substantially rigid padded material and the central region of the "U" is formed of resilient material.

10. A modular, self-contained protective carrying case of claim 1, wherein both the upper and lower extremities of the U-shaped sling are displaced from the top and bottom edges of the side boards.

11. A modular, self-contained protective carrying case of claim 1, wherein each of said side boards is rectangular, and said upper access opening is along the longer sides of the rectangles.

12. A modular, self-contained protective carrying case of claim 1, wherein each of said side boards is rectangular, and said upper access opening is along the shorter sides of the rectangles.

* * * * *